US007405378B1

(12) United States Patent
Whitlow

(10) Patent No.: US 7,405,378 B1
(45) Date of Patent: Jul. 29, 2008

(54) SAFETY BLANKET

(76) Inventor: Ernestine Marie Whitlow, 6840 Jamacha Rd., San Diego, CA (US) 92114

( * ) Notice: Subject to any disclaimer, the term of this patent is extended or adjusted under 35 U.S.C. 154(b) by 48 days.

(21) Appl. No.: 11/476,185

(22) Filed: Jun. 27, 2006

(51) Int. Cl.
*H05B 3/08* (2006.01)
*H05B 3/34* (2006.01)

(52) U.S. Cl. ..... 219/212; 219/529; 219/541

(58) Field of Classification Search ..... 219/211, 219/212, 528, 529, 545
See application file for complete search history.

(56) References Cited

U.S. PATENT DOCUMENTS 3,594,547 A 7/1971 Quinn
5,008,515 A 4/1991 McCormack
6,160,246 A * 12/2000 Rock et al. ..... 219/545
6,331,695 B1 12/2001 West
6,501,055 B2 * 12/2002 Rock et al. ..... 219/212
6,548,789 B1 4/2003 Rock et al.
6,770,854 B1 * 8/2004 Keane ..... 219/529
2006/0166082 A1 * 7/2006 Turner et al. ..... 219/212

FOREIGN PATENT DOCUMENTS

DE 29613024 * 1/1997

* cited by examiner

*Primary Examiner*—Joseph M Pelham

(57) ABSTRACT

A warming blanket for use by individuals is provided. The warming blanket has an integrated heat coil which can be heated up by a pair of attached battery packs. Each of the battery packs is removably attached and includes at least one battery. The warming blanket is ideally used as an extra safety feature for vehicles in case the vehicle is stranded during very cold or very bad weather, such as a snowstorm, in which warmth may play a crucial role in the survival of individuals within the vehicle. In addition, the warming blanket will assist in saving lives.

20 Claims, 1 Drawing Sheet

SAFETY BLANKET

This application claims the benefit of U.S. Provisional Patent Application No. 60/583,119, filed Jun. 25, 2004, and pending U.S. patent application Ser. No. 11/120,497, filed May 2, 2005.

BACKGROUND OF THE INVENTION

1. Field of the Invention

This invention relates generally to a safety blanket and, more particularly, the invention relates to a safety blanket usable to maintain a person's warmth.

2. Description of the Prior Art

U.S. Pat. No. 6,548,789, issued to Rock, discloses a heating and warming fabric such as a blanket that is powered by a battery.

U.S. Pat. No. 5,008,515, issued to McCormack, discloses a warming blanket having battery powered electrical heating elements for maintaining the temperature of a user.

U.S. Pat. No. 6,331,695, issued to West, discloses a warming blanket capable of being powered form various sources such as a rechargeable battery.

SUMMARY

The present invention concerns that of a new and improved warming blanket for use by individuals. The warming blanket has an integrated heat coil which can be heated up by a pair of attached battery packs. Each of the battery packs is removably attached and includes at least one battery. The warming blanket is ideally used as an extra safety feature for vehicles in case the vehicle is stranded during very cold or very bad weather, such as a snowstorm, in which warmth may play a crucial role in the survival of individuals within the vehicle.

There has thus been outlined, rather broadly, the more important features of a warming blanket that the detailed description thereof that follows may be better understood and in order that the present contribution to the art may be better appreciated. There are, of course, additional features of the warming blanket that will be described hereinafter and which will form the subject matter of the claims appended hereto.

In this respect, before explaining at least one embodiment of the warming blanket in detail, it is to be understood that the warming blanket is not limited in its application to the details of construction and to the arrangements of the components set forth in the following description or illustrated in the drawings. The warming blanket is capable of other embodiments and being practiced and carried out in various ways. Also, it is to be understood that the phraseology and terminology employed herein are for the purpose of descriptions and should not be regarded as limiting.

The safety blanket of the present invention can be used by everyone including, but not limited to, hospitals, police, homeless people, travelers, sports fans, campers, hikers, etc. The safety blanket can save lives by providing warmth from the cold. In addition, the safety blanket can be used by two people together who desire different temperatures on each side of the safety blanket for comfort and warmth while watching TV or during outdoor activities.

It is therefore an object of the present invention to provide a warming blanket which has all of the advantages of the prior art and none of the disadvantages.

It is another object of the present invention to provide a warming blanket which may be easily and efficiently manufactured and marketed.

It is another object of the present invention to provide a warming blanket which is of durable and reliable construction.

It is yet another object of the present invention to provide a warming blanket which is economically affordable and available for relevant market segment of the purchasing public.

Other objects, features and advantages of the present invention will become more readily apparent from the following detailed description of the preferred embodiment when considered with the attached drawings and appended claims.

DETAILED DESCRIPTION OF THE PREFERRED EMBODIMENTS

Figure 1:
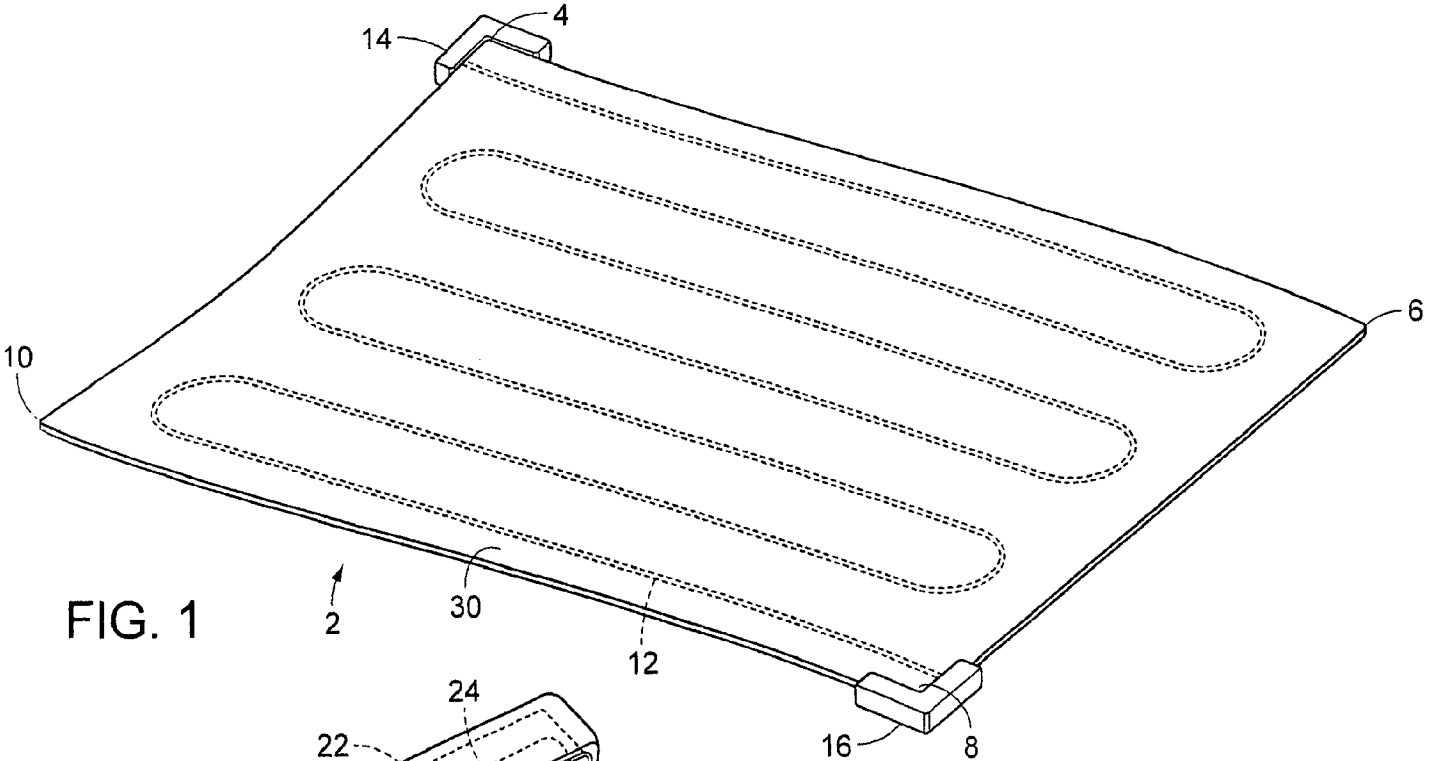
FIG. 1 is a perspective view illustrating a safety blanket, constructed in accordance with the present invention.

FIG. 1 illustrates a perspective view of the warming blanket 2. The warming blanket 2 has two surfaces comprising a top surface and a bottom surface, two ends, a first end and a second end, and two sides, a first side and a second side. The warming blanket 2 also has four corners 4, 6, 8, and 10. The corners 4 and 8 are opposite one another, while the corners 6 and 10 are opposite one another.

The warming blanket 2 preferably has a single heating coil 12 that is integrated into the warming blanket 2 before it is woven. The heating coil 12 has two ends, a first end and a second end. The first end is located near the corner 4, while the second end of heating coil 12 is located near the corner 8. It should be understood that it is within the scope of the present invention for the warming blanket 2 to have more than a single heating coil 12.

While traveling from the first end of the heating coil 12 to the second end of the heating coil 12, the heating coil 12 mostly travels from end to end in a serpentine manner in relation to the warming blanket 12. Just before reaching an end of the warming blanket 2, however, the heating coil 12 essentially does a one hundred eighty degree turn and heads toward the opposite end of the warming blanket 2. The only place in which the heating coil 12 actually touches the ends of the warming blanket 2 is at the first end of the heating coil 12 (which touches the first end of the warming blanket 2) and the second end of the heating coil 12 (which touches the second end of the warming blanket 2).

To properly power the present invention, L-shaped battery packs 14 and 16 are present. The L-shaped battery pack 14 is attached to the warming blanket 2 surrounding the corner 4 and is connected to the first end of the heating coil 12. The battery pack 16 is attached to the warming blanket 2 surrounding the corner 8 and is connected to the second end of the heating coil 12. Each battery pack is removably mounted surrounding the appropriate corner and can be removed to allow changing of one or more batteries within the battery pack. Furthermore, each battery pack can be operated independently of the other battery pack thereby allowing the warming blanket 2 to have two different heat zones.

The warming blanket 2 can be fabricated from a wide variety of fabrics 30, with the key desirable characteristic of the fabric 30 being warmth. The warming blanket 2 can serve a wide variety of functions, but is most desirably used as an extra safety feature within a vehicle in case it is stranded in very cold weather or inclement weather, such as a snowstorm.

Figure 2:
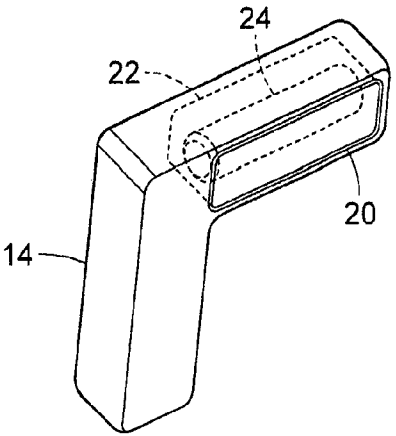
FIG. 2 is close-up representational view illustrating a battery pack for the safety blanket, constructed in accordance with the present invention.

FIG. 2 illustrates a close-up representational view of the L-shaped battery pack 14. The battery pack 14 is shown in a bottom perspective view, with a battery panel access door 20 showing. Within the door 20 is located a battery compartment 22, with at least one battery 24 inside. To remove the battery 24, an individual need only remove the battery access panel door 20 so that the battery 24 can be accessed.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A warming apparatus comprising:

a blanket having a top surface, a bottom surface, a first end, a second end, a first side, and a second side, the blanket also having a first corner, a second corner, a third corner, and a fourth corner, wherein the first corner and the third corner are diagonally opposite one another, further wherein the second corner and the fourth corner are diagonally opposite one another, the blanket further having a perimeter edge extending along the first end, the second end, the first side, and the second side;

a heating coil having a first end and a second end, the first end of the heating coil located at the first corner of the blanket, the second end of the heating coil located at the third corner of the blanket, the heating coil embedded within the blanket; and first L-shaped power means for providing power to the heating coil, the first L-shaped power means abutting and contacting the perimeter edge only and surrounding the first corner, the first L-shaped power means having a first section secured directly to perimeter edge of the blanket between the first corner and the second corner and a second section secured directly to the perimeter edge of the blanket between the first corner and the fourth corner;

wherein the L-shaped power means abuts the perimeter edge at the first corner and is substantially free from extension over either the top surface or the bottom surface of the blanket.

2. The warming apparatus of claim 1 and further comprising:

second L-shaped power means for providing power to the heating coil, the second L-shaped power means surrounding the third corner, the second L-shaped power means having a first section secured directly to the blanket between the third corner and the second corner and a second section secured directly to the blanket between the third corner and the fourth corner.

3. The warming apparatus of claim 2 wherein the first L-shaped power means is a first battery pack and the second L-shaped power means is a second battery pack, each battery pack having an internal battery compartment, each battery compartment of each battery pack having at least one battery, wherein each battery compartment is covered by a battery panel access door.

4. The warming apparatus of claim 1 wherein the heating coil coils back and forth in between the first corner and third corner of the blanket, further wherein the heating coil repeatedly makes one hundred eighty degree turns in between the first corner and the third corner of the blanket.

5. The warming apparatus of claim 1 wherein the first L-shaped power means is removable from the blanket.

6. The warming apparatus of claim 2 wherein the second L-shaped power means is removable from the blanket.

7. The warming apparatus of claim 2 wherein the first L-shaped power means and the second L-shaped power means are operable independently of each other thereby heating one side of the blanket to a different temperature than the other side of the blanket.

8. A warming apparatus comprising:

a blanket having a top surface, a bottom surface, a first end, a second end, a first side, and a second side, the blanket also having a first corner, a second corner, a third corner, and a fourth corner, wherein the first corner and the third corner are diagonally opposite one another, further wherein the second corner and the fourth corner are diagonally opposite one another, the blanket further having a perimeter edge extending along the first end, the second end, the first side, and the second side;

a heating coil having a first end and a second end, the first end of the heating coil located at the first corner of the blanket, the second end of the heating coil located at the third corner of the blanket, the heating coil embedded within the blanket, and first power means secured directly to the blanket along the perimeter edge and surrounding the first corner for providing power to the heating coil;

wherein the first power means abuts and contacts the perimeter edge only at the first corner and is substantially free from extension over either the top surface or the bottom surface of the blanket.

9. The warming apparatus of claim 8 wherein the first power means to provide power to the heating coil further comprises a pair of battery packs comprising a first battery pack and a second battery pack, each battery pack having an internal battery compartment, each battery compartment of each battery pack having at least one battery, wherein each battery compartment is covered by a battery panel access door.

10. The warming apparatus of claim 8 wherein the heating coil coils back and forth in between the first corner and third corner of the blanket, further wherein the heating coil repeatedly makes one hundred eighty degree turns in between the first corner and the third corner of the blanket.

11. The warming apparatus of claim 8 and further comprising:

second power means secured directly to the blanket and surrounding the third corner to provide power to the heating coil.

12. The warming apparatus of claim 11 wherein the second power means to provide power to the heating coil further comprises a pair of battery packs comprising a first battery pack and a second battery pack, each battery pack having an internal battery compartment, each battery compartment of each battery pack having at least one battery, wherein each battery compartment is covered by a battery panel access door.

13. The warming apparatus of claim 8 wherein the first power means is removable from the blanket.

14. The warming apparatus of claim 11 wherein the second power means is removable from the blanket.

15. A method for warming an individual, the method comprising:

providing a blanket having a top surface, a bottom surface, a first end, a second end, a first side, and a second side, the blanket also having a first corner, a second corner, a third corner, and a fourth corner, wherein the first corner and the third corner are diagonally opposite one another, further wherein the second corner and the fourth corner are diagonally opposite one another, the blanket further having a perimeter edge extending along the first end, the second end, the first side, and the second side;

providing a heating coil having a first end and a second end;

positioning the first end of the heating coil at the first corner of the blanket;

positioning the second end of the heating coil at the third corner of the blanket;

winding the heating coil through the blanket in a serpentine manner; and securing first power means directly to the blanket;

abutting and contacting the perimeter edge only about the first corner with the first power means; and powering the heating coil.

16. The method of claim 15 wherein the first power means comprises a pair of battery packs comprising a first battery pack and a second battery pack, each battery pack having an internal battery compartment, each battery compartment of each battery pack having at least one battery, wherein each battery compartment is covered by a battery panel access door.

17. The method of claim 15 and further comprising:

securing second power means directly to the blanket;

surrounding the third corner with the second power means; and powering the heating coil.

18. The method of claim 17 wherein the second power means to provide power to the heating coil further comprises a pair of battery packs comprising a first battery pack and a second battery pack, each battery pack having an internal battery compartment, each battery compartment of each battery pack having at least one battery, wherein each battery compartment is covered by a battery panel access door.

19. The method of claim 15 wherein the first power means is removable from the blanket.

20. The method of claim 17 wherein the second power means is removable from the blanket.

* * * * *